US011118547B1

(12) United States Patent
Lohr et al.

(10) Patent No.: US 11,118,547 B1
(45) Date of Patent: Sep. 14, 2021

(54) SYSTEMS FOR INTAKE MANIFOLD SECONDARY GAS DISTRIBUTION

(71) Applicant: Ford Global Technologies, LLC, Dearborn, MI (US)

(72) Inventors: John Lohr, Beverly Hills, MI (US); Murray Griffin, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/142,919

(22) Filed: Jan. 6, 2021

(51) Int. Cl.
*F02M 35/104* (2006.01)
*F02M 35/10* (2006.01)

(52) U.S. Cl.
CPC .... *F02M 35/10229* (2013.01); *F02M 35/104* (2013.01); *F02M 35/10072* (2013.01); *F02M 35/10085* (2013.01); *F02M 35/10222* (2013.01); *F02M 35/10262* (2013.01)

(58) Field of Classification Search
CPC ..... F02M 35/10229; F02M 35/10072; F02M 35/10222; F02M 35/10085; F02M 35/10262; F02M 35/04
See application file for complete search history.

(56) References Cited

U.S. PATENT DOCUMENTS

| | | | | |
|---|---|---|---|---|
| 4,270,508 | A | 6/1981 | Lindberg | |
| 4,475,509 | A * | 10/1984 | Hayashida | F02M 35/10183 123/432 |
| 4,528,969 | A | 7/1985 | Senga | |
| 4,686,952 | A | 8/1987 | Zeigler, Jr. et al. | |
| 7,017,562 | B2 | 3/2006 | Jeon | |
| 7,886,727 | B2 | 2/2011 | Ulrey et al. | |
| 8,813,728 | B2 | 8/2014 | Wong et al. | |
| 9,027,536 | B2 | 5/2015 | Pursifull et al. | |
| 2018/0335001 | A1* | 11/2018 | Lohr | F02M 35/10229 |

* cited by examiner

*Primary Examiner* — Jacob M Amick
(74) *Attorney, Agent, or Firm* — Geoffrey Brumbaugh; McCoy Russell LLP

(57) ABSTRACT

An intake system of an engine is provided. The intake system may include an intake manifold coupled to a first throttle body and a second throttle body, where the intake manifold is formed from an upper shell and a lower shell. The intake system further includes a vacuum port located in the intake manifold and in an air-flow path downstream of the first throttle body and the second throttle body and upstream of a plurality of intake runners of the intake manifold, the vacuum port including a spigot extending through the upper shell of the intake manifold, and a vacuum passage coupling the vacuum port to a vehicle subsystem.

20 Claims, 9 Drawing Sheets

SYSTEMS FOR INTAKE MANIFOLD SECONDARY GAS DISTRIBUTION

BACKGROUND/SUMMARY

Intake manifolds in internal combustion engines may include various ports for introducing gases into the intake manifold. In some examples, the ports may be coupled to systems which utilize the vacuum generated within the intake manifold to supplement various operations. For example, the intake manifold may be in fluidic communication with a positive crankcase ventilation system, a brake system, an evaporative emission system (e.g., vapor canisters), etc.

However, the inventors herein have recognized that in some systems gases introduced into the intake manifold from the ports may not fully mix with the air in the intake manifold, increasing combustion variability and decreasing engine efficiency. This problem may be pronounced in engine systems with more than one throttle body.

As such, various example systems and approaches are described herein. In one example an intake system of an engine includes an intake manifold coupled to a first throttle body and a second throttle body, where the intake manifold is formed from an upper shell and a lower shell. The intake system further includes a vacuum port located in the intake manifold and in an air-flow path downstream of the first throttle body and the second throttle body and upstream of a plurality of intake runners of the intake manifold, the vacuum port including a spigot extending through the upper shell of the intake manifold, and a vacuum passage coupling the vacuum port to a vehicle subsystem.

In this way, the vacuum port may inject secondary gases from the vehicle subsystem to the intake manifold at a position downstream of both throttle bodies, where mixing of the secondary gases and intake gases may occur. Thus, the secondary gases may be distributed evenly to the cylinders of the engine.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE FIGURES

FIGS. 3-8 are drawn to scale, although other relative dimensions could be used.

DETAILED DESCRIPTION

Engine intake manifolds may generate vacuum, which may be used to power certain accessory components (e.g., a brake booster) and/or draw various secondary gases into the engine, such as fuel vapors from a fuel vapor canister and/or gases from a positive crankcase ventilation system. The secondary gases may include air and in some examples fuel vapors or other gases. Thus, to ensure each cylinder of the engine receives a similar amount of air and fuel, even distribution of the secondary gases to all cylinders is desired. Typical engine systems may include a secondary gas port (e.g., a hole) near the throttle flange, which results in a relatively even distribution of the secondary gases. However, some engine systems include more than one throttle body. With a two throttle body system, a single port/hole near one of the throttle flanges does not evenly distribute the secondary gases, leading to combustion instability and/or increased emissions.

Thus, a secondary gas distribution feature integrated into an intake manifold of an engine having two throttle bodies is described herein. The secondary gas distribution feature includes a spigot integrated into an upper shell of the intake manifold at a position behind and intermediate the two throttle body mounting flanges, upstream of a plurality of intake runners. The spigot may extend vertically into the interior of the intake manifold and may terminate at a point midway between the top and the bottom of the throttle body mounting flanges. Further, the secondary gas distribution feature may include a flow disruptor integrated in a lower shell of the intake manifold. The flow disruptor may be aligned with the spigot, thereby creating a slot out of which the secondary gases may flow. The flow disruptor may increase turbulence within the intake manifold. In turn the turbulence may promote mixing of the gases from the spigot with gases flowing through the throttle bodies and into the intake manifold. The flow disruptor may include a dome or slot features to fine-tune the distribution of the secondary gases. In this way, combustion efficiency may be increased.

Figure 1:
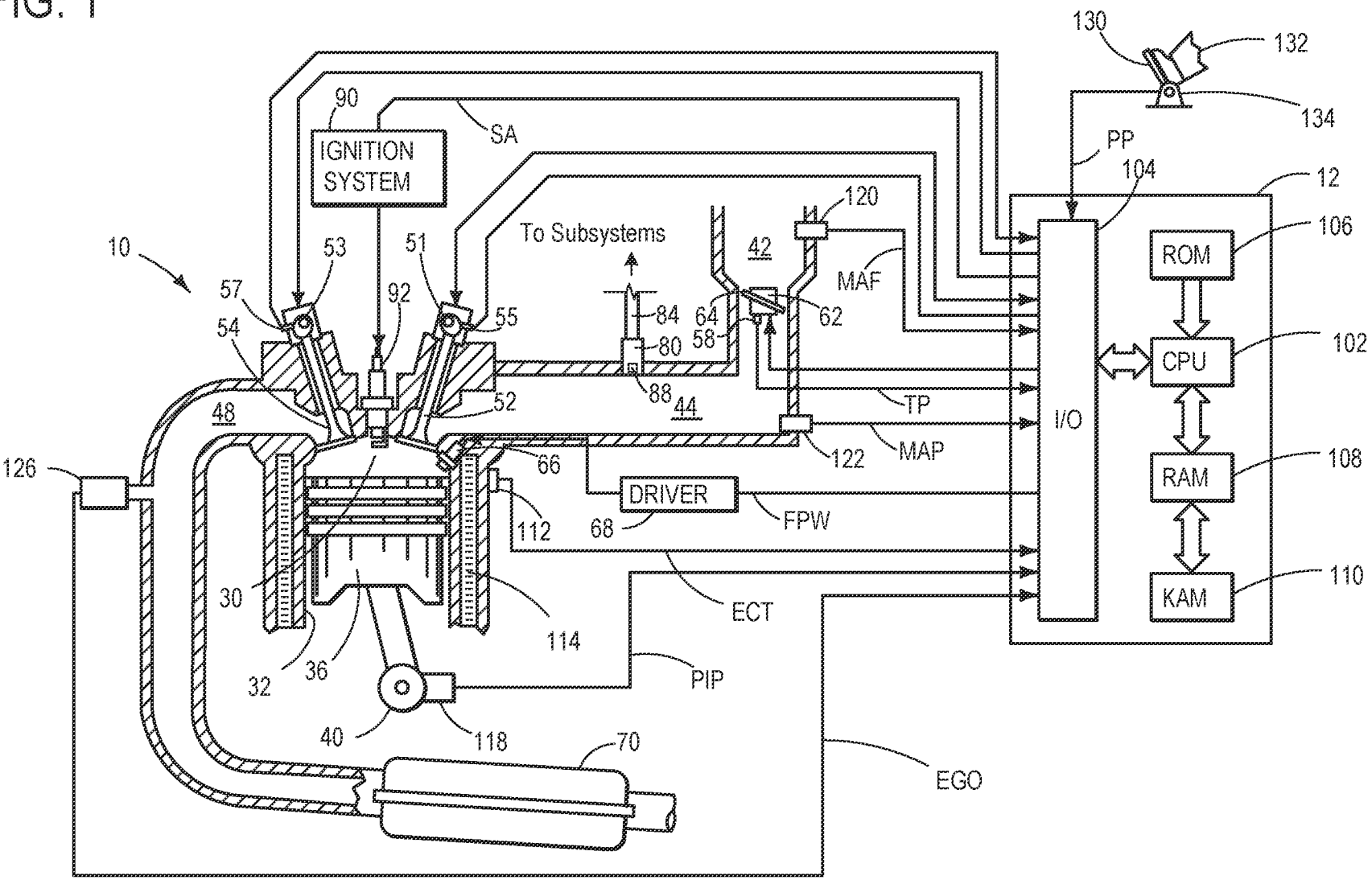
FIG. 1 shows a schematic depiction of an internal combustion engine.
Figure 2:
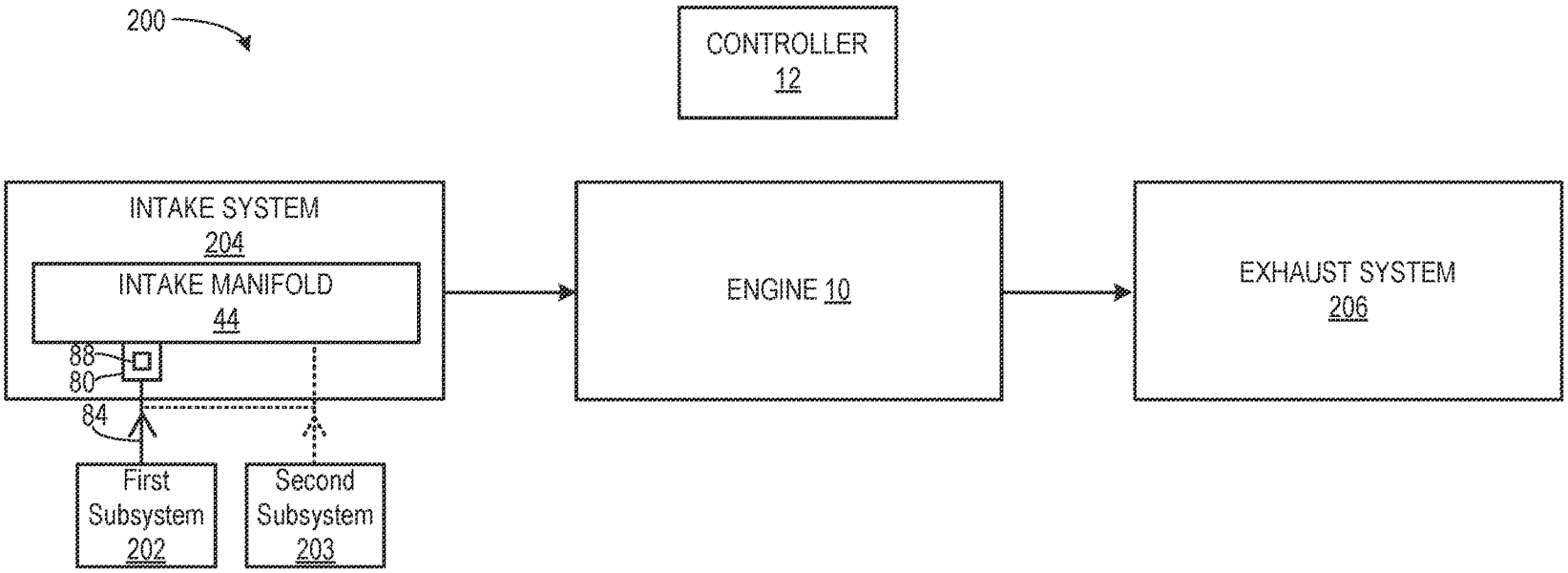
FIG. 2 shows a schematic depiction of a vehicle including the internal combustion engine shown in FIG. 1.
Figure 7:
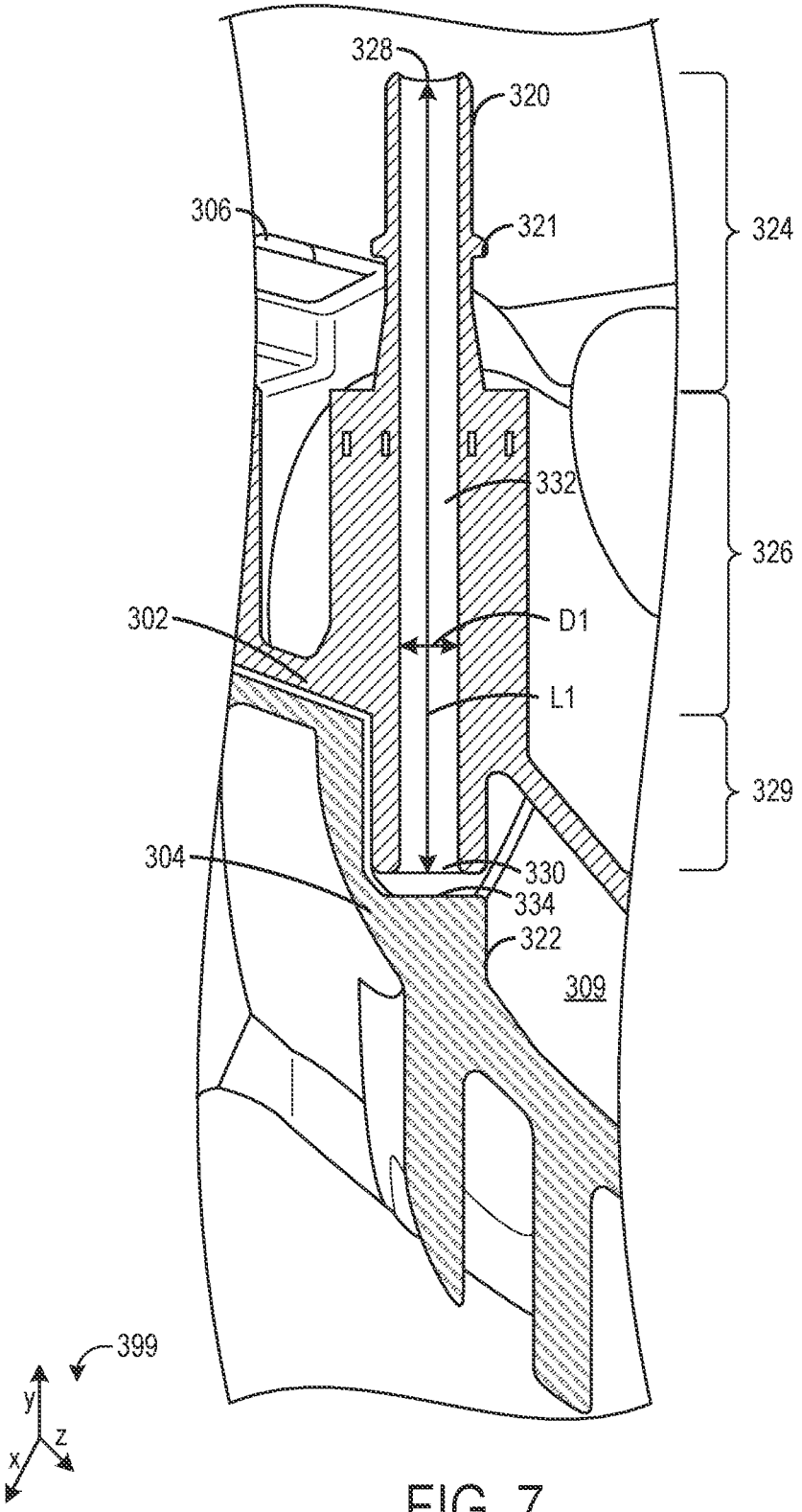
FIG. 7 shows a cross-section view of the vacuum port of FIGS. 5-6.
Figure 8:
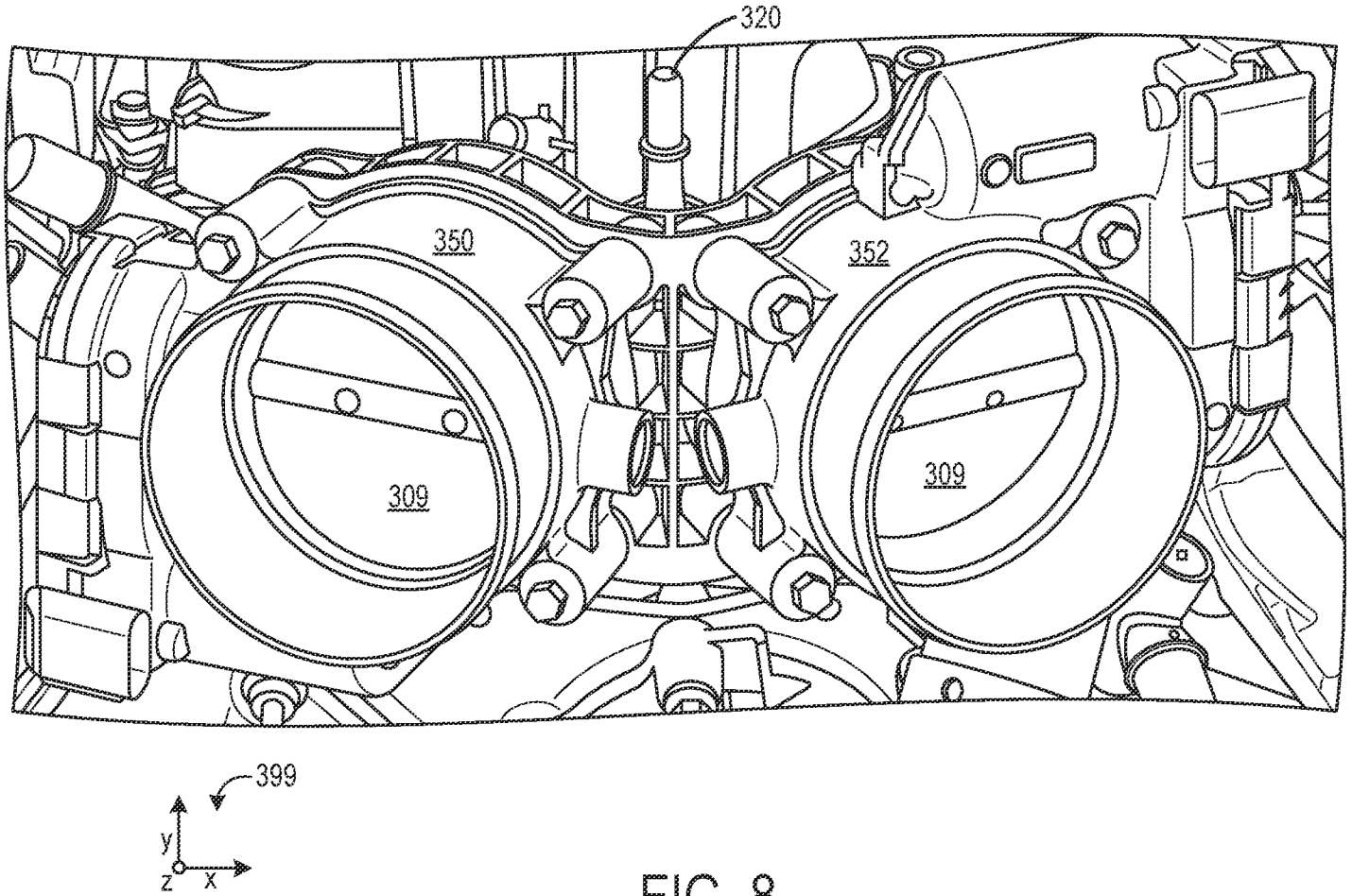
FIG. 8 shows a perspective view of the intake manifold of FIG. 3 including throttle bodies coupled to the intake manifold.
Figure 9:
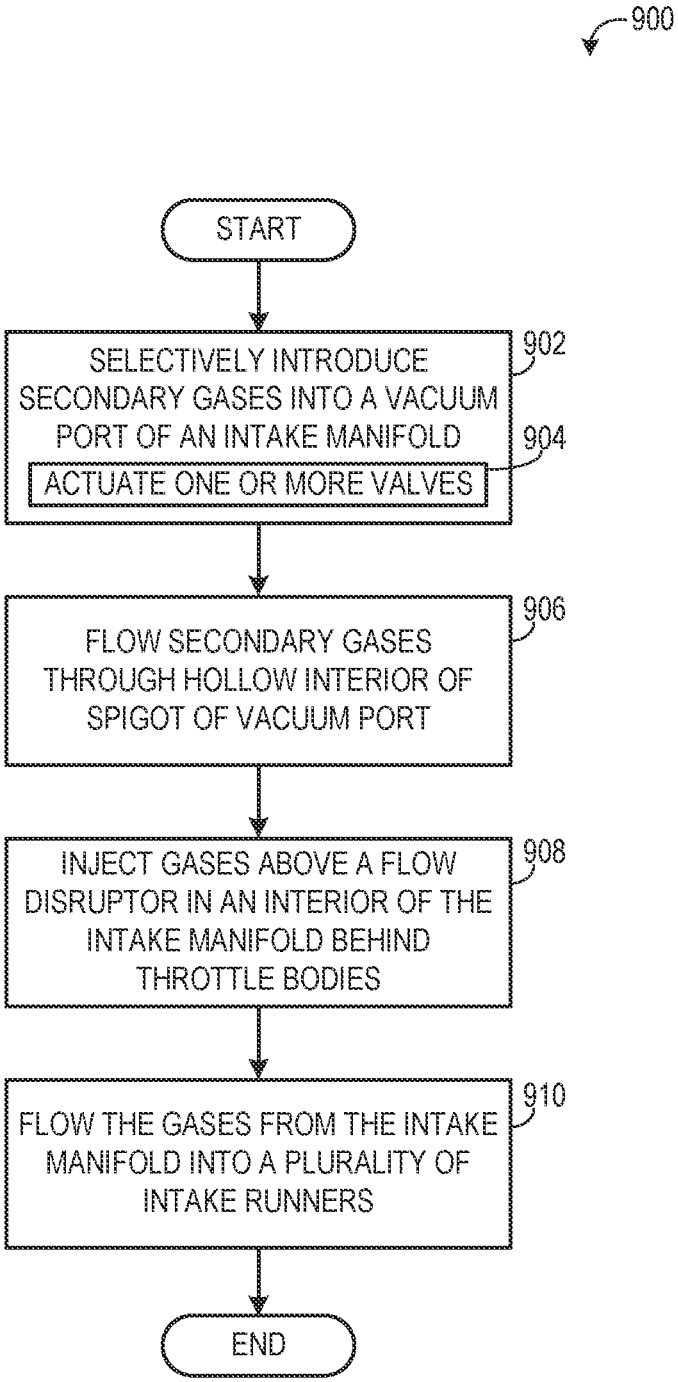
FIG. 9 shows a method for operation of an intake system in an internal combustion engine.

FIGS. 1 and 2 show schematic depictions of an engine and accompanying intake system. FIGS. 3-8 show various view of an example intake manifold including a vacuum port having a flow disruptor. FIG. 9 shows a method for operation of an intake system.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Intake manifold 44 is also shown intermediate of intake valve 52 and air intake zip tube 42. Fuel is delivered to fuel injector 66 by a fuel system (not shown) including a fuel tank, fuel pump, and fuel rail. Engine 10 of FIG. 1 is configured such that the fuel is injected directly into the engine cylinder, which is known to those skilled in the art as direct injection. However, port injection may be used in other embodiments. Fuel injector 66 is supplied operating current from driver 68 which responds to controller 12. In addition, intake manifold 44 is shown communicating with optional electronic throttle 62 with throttle plate 64. In one example, a low pressure direct injection system may be used, where fuel pressure can be raised to approximately 20-30 bar. Alternatively, a high pressure, dual stage, fuel system may be used to generate higher fuel pressures.

A first vacuum port 80 is coupled to intake manifold 44. The first vacuum port is coupled to vacuum passage 84 that may be coupled to one of the following vehicle subsystems: a brake system, a crankcase ventilation system, an evaporative emission system, and an exhaust gas recirculation (EGR) system. Therefore, the first vacuum port may be a brake boost port, a positive crankcase ventilation port, or a fuel vapor purge port. In this way gases from the aforementioned subsystems may be drawn into the intake manifold during certain engine operating conditions, such as when the intake manifold is below atmospheric pressure. As shown, the first vacuum port includes a flow disruptor 88. Although the flow disruptor is generically represented as a box it will be appreciated that the flow disruptor may have a geometric configuration conducive to facilitating distribution of secondary gases within the intake manifold. FIGS. 3-7 show detailed illustrations of an example flow disruptor, discussed in greater detail herein. Further in other embodiments additional vacuum ports may be coupled to the intake manifold.

Distributorless ignition system 90 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a microcomputer including: microprocessor unit 102, input/output ports 104, read-only memory 106, random access memory 108, keep alive memory 110, and a data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. However, in other examples compression ignition may be used. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

A schematic depiction of a vehicle 200 including a first vehicle subsystem 202 and a second vehicle subsystem 203 is shown in FIG. 2. As illustrated an intake system 204 including intake manifold 44 is coupled to engine 10 which is coupled to exhaust system 206. The first subsystem is coupled to vacuum passage 84. Vacuum passage 84 is coupled to the intake manifold via vacuum port 80 including a flow disruptor 88. In some examples, the second vehicle subsystem 203 is additionally or alternatively coupled to vacuum passage 84. In other examples, the second vehicle subsystem 203 is coupled to intake manifold 44 via a second, different vacuum passage (not shown).

As previously discussed, the vehicle subsystems may be operated to enable gases to flow through the intake port while a vacuum is present in the intake manifold. In this way, fluidic communication between the first vehicle subsystem and the intake manifold may be selectively enabled. It will be appreciated that a vacuum may be generated when combustion cycles are occurring in the engine and the throttle is at least partially obstructing airflow in the intake system. For example, the evaporative emission system may be purged while a vacuum is generated in the intake manifold. Purging the evaporative emission system may include enabling fluidic communication between a vapor canister and the intake manifold. Additionally, air may be circulated through the crankcase to the intake manifold when a vacuum is present in the intake manifold. Moreover, exhaust gas may be re-circulated via the EGR system when a vacuum is present in the intake manifold. The EGR system may include a loop coupling the intake system to the exhaust system. Additionally, the brake system may enable fluidic communication with the intake manifold when additional braking assistance has been requested and a vacuum is present in the intake manifold.

Figure 3:
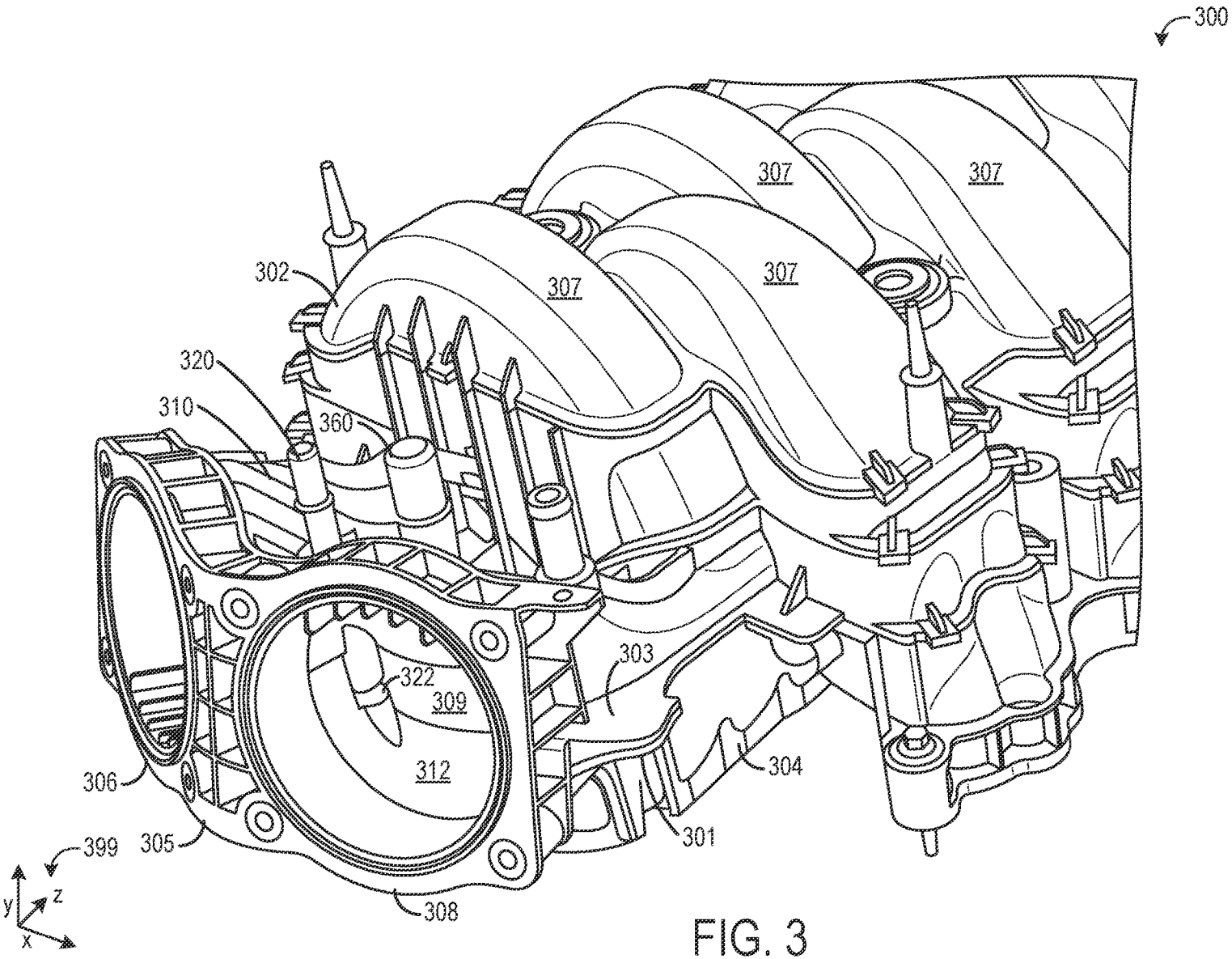
FIG. 3 shows a perspective view of an example intake manifold.
Figure 4:
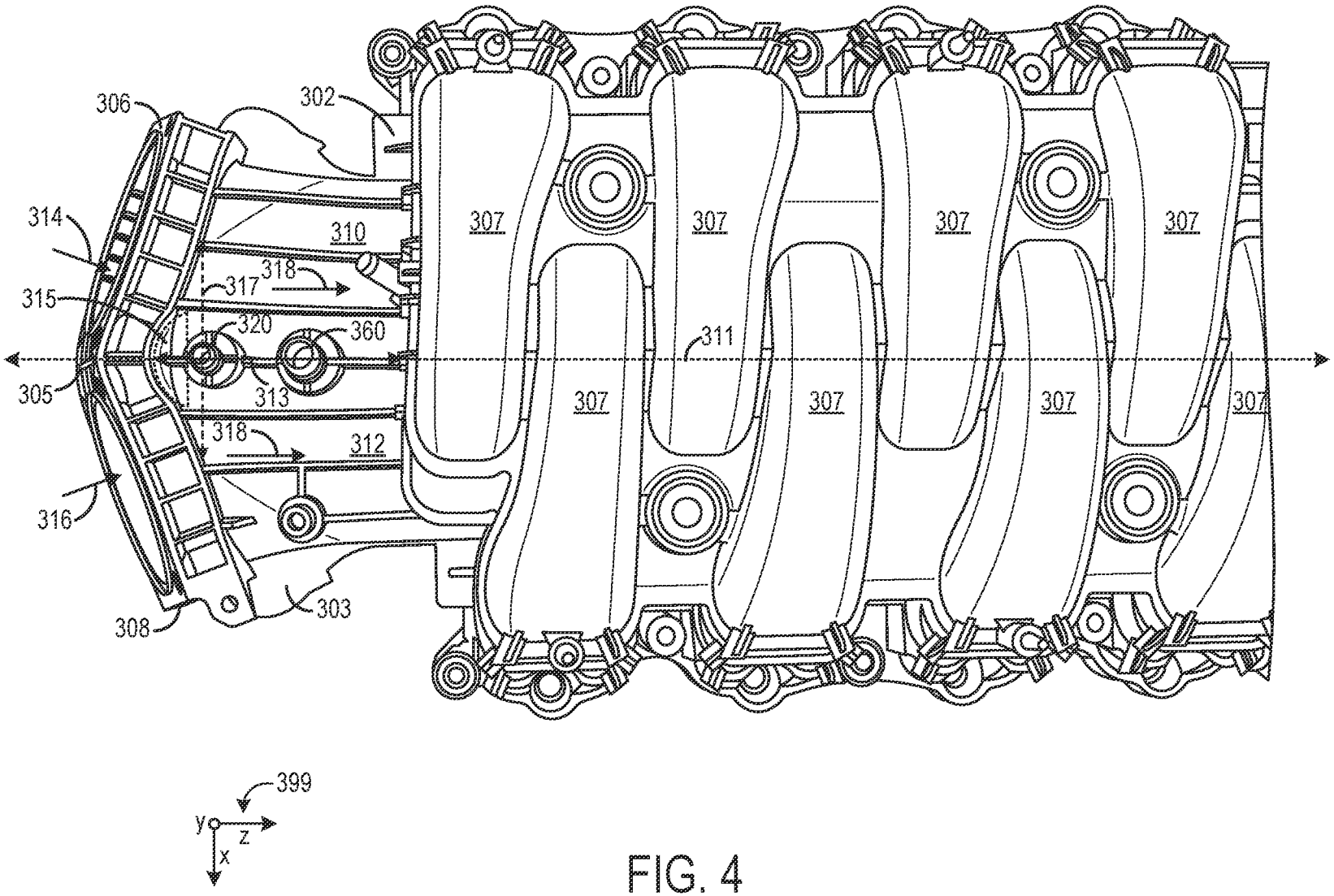
FIG. 4 shows a top view of the intake manifold of FIG. 3.

Now referring to FIG. 3, it shows a perspective view of an example intake manifold 300 configured to supply air to V-8 engine, which may be a turbocharged or naturally aspirated engine. It will be appreciated that the intake manifold shown in FIG. 3 is drawn approximately to scale. Intake manifold 300 may be intake manifold 44 shown in FIG. 1. Further, intake manifold 300 may be configured to supply air to an engine having a different configuration, e.g., a V-6 engine, 14 engine, etc. FIGS. 4 and 8 show additional views of the intake manifold 300 (a top down view and a front view, respectively), and thus FIGS. 3, 4, and 8 are described collectively. Each of FIGS. 3, 4, and 8 includes a set of reference axes 399. In some examples, the y axis may be parallel to a direction of gravity, but other orientations are possible.

The intake manifold may include an upper shell 302 and a lower shell 304. The upper and lower shells may be molded via a suitable molding process, such as injection molding. However, in other embodiments the upper and lower shells may be constructed via another suitable technique. Additionally, the upper and lower shells are held together by a suitable mechanism (e.g., fasteners, welding) and may be sealed with gaskets to reduce the possibility of drawing unmetered air into the engine. The upper shell 302 includes an upper coupling flange 303 that extends around a lower perimeter of the upper shell 302. The lower shell 304 includes a lower coupling flange 301 that extends around an upper perimeter of the lower shell 304. The upper coupling flange 303 may interface with the lower coupling flange 301 (e.g., via direct, face-sharing contact between the two coupling flanges and/or via a gasket) to provide a coupling interface via which the upper shell 302 may couple to the lower shell 304.

Intake manifold 300 includes a first throttle body mounting flange 306 for coupling a first throttle body 350 (shown in FIG. 8) to intake manifold 300 and a second throttle body mounting flange 308 for coupling a second throttle body 352 (shown in FIG. 8) to intake manifold 300. The first throttle body mounting flange 306 may be coupled to the second throttle body mounting flange 308 via an intermediate portion 305. Each throttle body mounting flange may include a front face configured to couple to a respective throttle body and a rear face, opposite the front face, configured to couple to the intake manifold 300 (e.g., to the upper shell 302 and the lower shell 304). Each throttle body mounting flange may include an opening extending from the front face to the rear face, via which intake gases may be admitted to the intake manifold 300. The respective throttle body effective area may be increased and decreased to allow the engine air amount to meet operator demands by opening and closing a respective throttle valve. In this way, a vacuum may be generated within the intake manifold during certain operating conditions.

The intake manifold may further include a plurality of intake runners 307 positioned downstream of the throttle body mounting flanges. Each intake runner may be coupled to at least one engine intake valve. Thus, the intake manifold may direct gases into the engine for combustion via the intake runners.

The intake manifold further includes a first throat 310 and a second throat 312 extending between the first and second throttle body mounting flanges 306, 308 and the intake runners 307. The first throat 310 may be coupled to the first throttle body mounting flange 306 and the second throat 312 may be coupled to the second throttle body mounting flange 308. The first throat 310 and the second throat 312 may collectively form a restriction or a flow channel for the flow of intake gases from the throttle valves to an interior volume of the intake manifold 300 (e.g., a plenum). The first throat 310 and the second throat 312 may be formed by the upper shell 302 and the lower shell 304. The first throat 310 and the second throat 312 may be fluidly coupled to each other, such that a single interior volume 309 is formed by the first throat 310 and the second throat 312, upstream of the intake runners 307. The first throat 310 and the second throat 312 may be generally circular in cross-section (at least where the first throat 310 and the second throat 312) couple to the throttle body mounting flanges) and thus the upper shell 302 may form a valley with a trough 313 of the valley being a region where the first throat 310 couples to the second throat 312 (as shown in FIG. 4). The lower shell 304 may include a corresponding curvature (e.g., forming an inverse valley).

In some examples, the first throttle body mounting flange 306 and the second throttle body mounting flange 308 may each be angled relative to an extent of the first throat 310 and the second throat 312. As shown in FIG. 4, the intake manifold 300 may have a central longitudinal axis 311 that extends parallel to the z axis of the set of reference axes 399. The central longitudinal axis 311 may bisect the intermediate portion 305 and may extend along the trough 313 where the first throat 310 couples to the second throat 312. The first throttle body mounting flange 306 may be positioned at an angle relative to the central longitudinal axis 311, such that the front face and the rear face of the first throttle body mounting flange 306 each extend from an outer edge of the first throttle body mounting flange 306 to the intermediate portion 305 at a non-perpendicular angle relative to the central longitudinal axis 311 (e.g., at an angle in a range of 60-80°) Likewise, the second throttle body mounting flange 308 may be positioned at an angle relative to the central longitudinal axis 311, such that the front face and the rear face of the second throttle body mounting flange 308 each extend from an outer edge of the second throttle body mounting flange 308 to the intermediate portion 305 at a non-perpendicular angle relative to the central longitudinal axis 311 (e.g., at an angle in a range of 60-80°).

In contrast, the first throat 310 and the second throat 312 extend parallel to the central longitudinal axis 311. For example, each of the first throat 310 and the second throat 312 has a central longitudinal axis that is parallel to the central longitudinal axis 311. When the engine is operating and intake gases are ingested to the engine via the intake manifold 300, with both throttle valves at least partially open, the intake gases may flow through the first throttle body mounting flange 306 along the direction shown by arrow 314 and through the second throttle body mounting flange 308 along the direction shown by arrow 316. The intake gases may mix in the interior volume 309 of the first throat 310 and the second throat 312 and flow through the first throat 310 and the second throat 312 along the direction shown by arrows 318. As a result of the angling of the first and second throttle body mounting flanges 306, 308 and the straight extension of the first and second throats 310, 312, a triangular or semicircular coupling region 315 may be formed by the first throat 310 and the second throat 312 coupling to the intermediate portion 305. As shown in FIG. 4, the coupling region 315 may be formed by a rear face of the intermediate portion 305, which may be curved in a concave manner from the rear face of the first throttle body mounting flange 306 to the rear face of the second throttle body mounting flange 308 and away from the intake runners 307, as well as a front face of the upper shell 302 and the lower shell 304.

Intake manifold 300 further includes a vacuum port 320 positioned downstream of the throttle body mounting flanges 306, 308 and upstream of intake runners 307 (e.g., the vacuum port 320 is located in the intake manifold and in an air-flow path downstream of the first throttle body and the second throttle body and upstream of the plurality of intake runners of the intake manifold). As previously discussed, the vacuum port 320 may be coupled to one of the following subsystems: a crankcase ventilation system, a brake system, an evaporative emission system, and an EGR system via a vacuum passage. In other embodiments additional ports may be included in first throat 310 and/or second throat 312. The vacuum port 320 may be integrated in/included as part of the upper shell 302 and may be positioned at the trough 313 between the first throat 310 and the second throat 312. The vacuum port 320 may be positioned proximate the coupling region 315 and thus spaced apart from the rear face of the intermediate portion 305 by a relatively small amount, e.g., a distance less than or equal to a thickness of the mounting flanges. In the example shown in FIG. 4, a transverse axis 317 that is perpendicular to the central longitudinal axis 311 and that bisects the vacuum port 320 may intersect the first throttle body mounting flange 306 and the second throttle body mounting flange 308. By positioning the vacuum port 320 near the coupling region 315 and at the trough 313 between the first throat 310 and the second throat 312 (and thus adjacent to the intermediate portion coupling the throttle body mounting flanges), the secondary gases that flow through the vacuum port 320 may be injected into the interior volume 309 formed by the first throat 310 and the second throat 312 at a region of relatively high turbulence (e.g., due to the intake gases flowing through the first throttle body mounting flange 306 and through the second throttle body mounting flange 308 impinging and mixing at the coupling region 315 and along the trough 313), which may facilitate enhanced mixing of the secondary gases with the intake gases.

As shown in FIG. 3, the vacuum port 320 may be in the form of a spigot extending vertically (e.g., parallel to the y axis of the set of reference axes 399) from above a top surface of the upper shell 302 to a region in the interior volume 309 of the first throat 310 and the second throat 312, above the lower shell 304. The vacuum port 320 may include a portion extending above the upper shell 302 and a portion extending within and below the upper shell 302. Additional details of the structure of the vacuum port 320 are provided below with respect to FIGS. 5-7, which illustrate magnified views of the vacuum port 320. Further, the lower shell 304 may include an integrated flow disruptor 322. Flow disruptor 322 may be disposed vertically below the vacuum port 320 and may assist in evenly distributing the secondary gases. The geometric characteristics of the flow disruptor are discussed in greater detail herein with regard to FIGS. 5-7.

Figure 5:
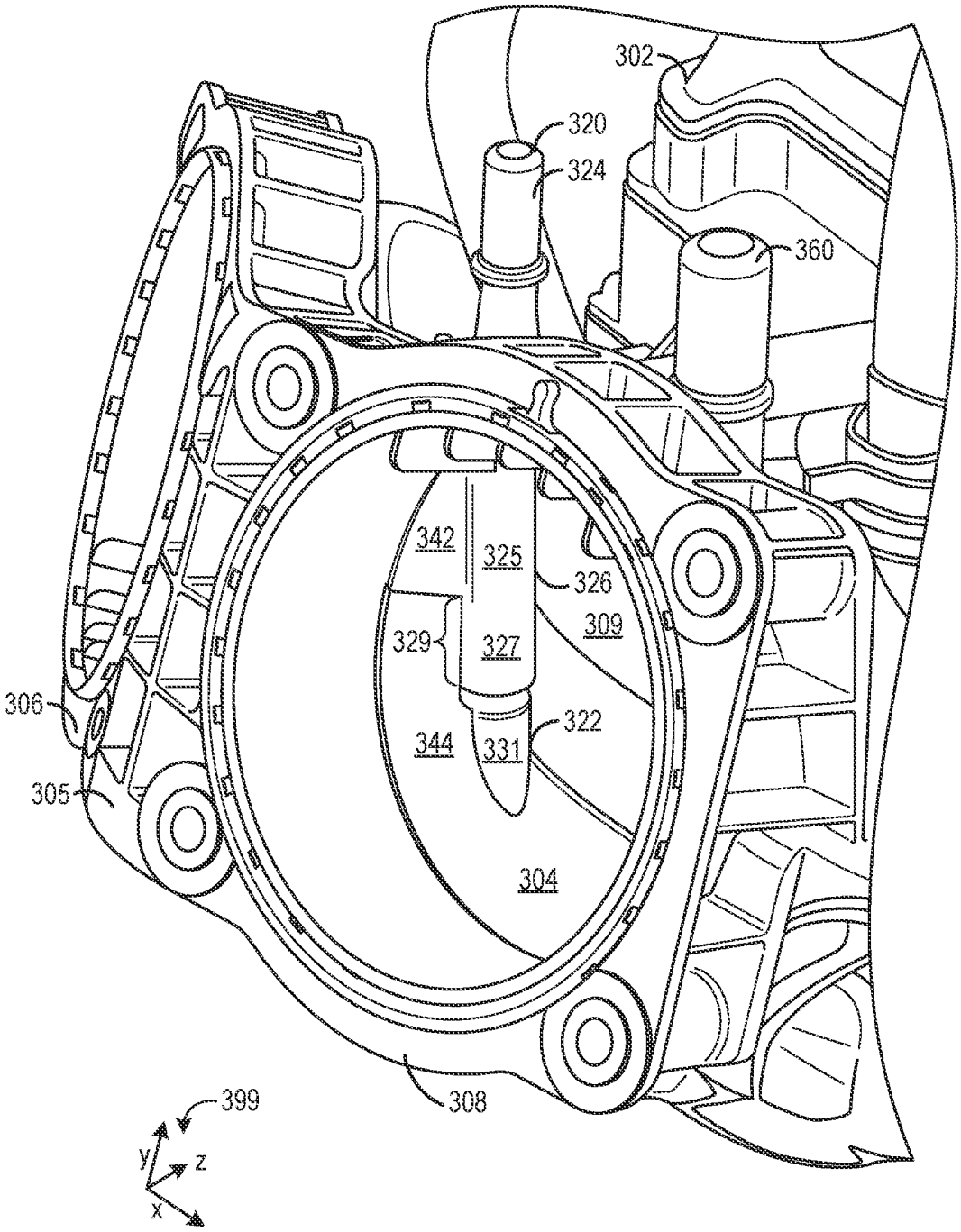
FIGS. 5-6 show magnified perspective views of the intake manifold of FIG. 3 including a vacuum port.
Figure 6:
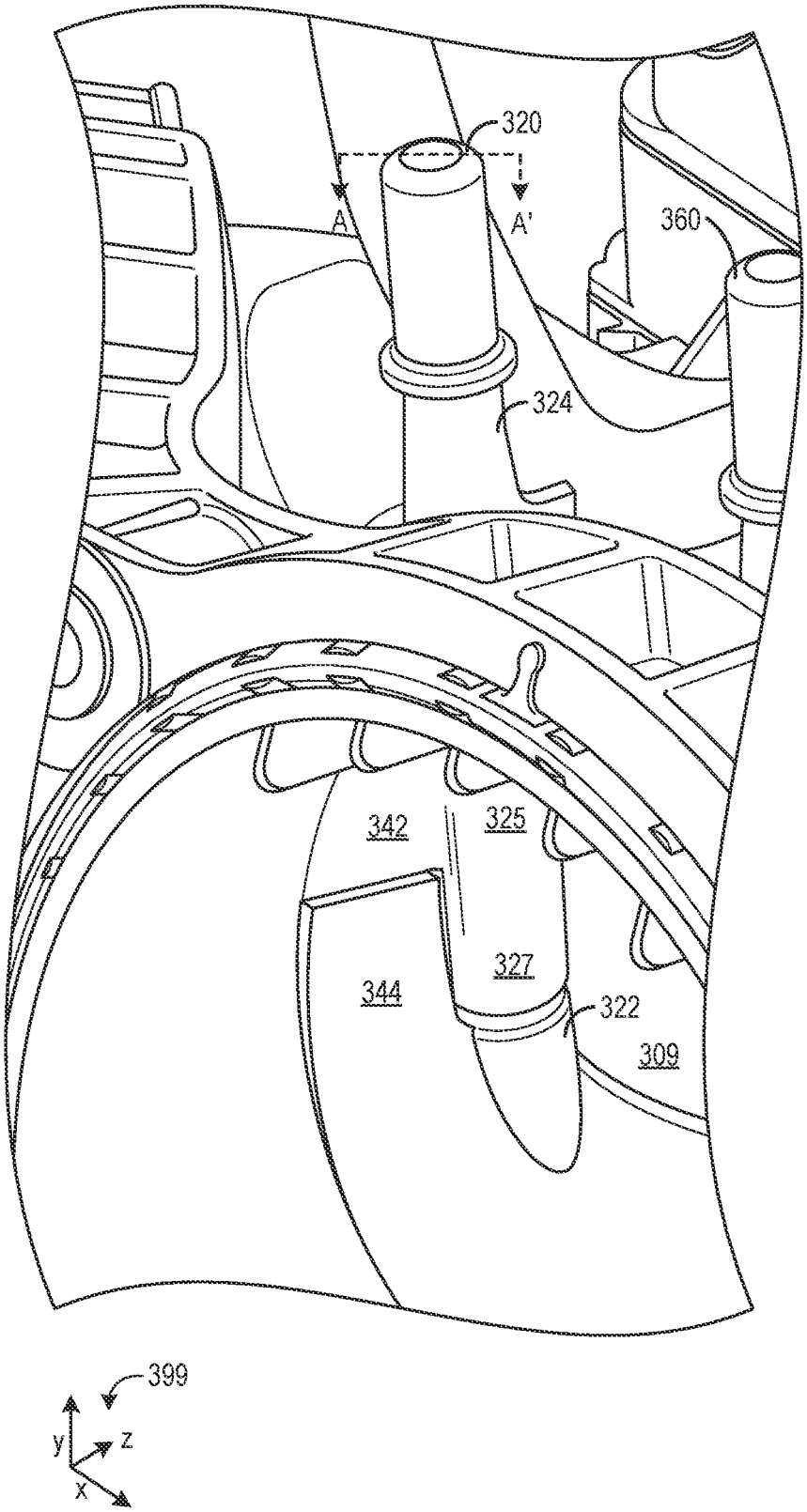

FIGS. 5 and 6 show magnified views of the vacuum port 320 and flow disruptor 322. FIG. 7 shows a cross-sectional view of the vacuum port 320 taken across line A-A' of FIG. 6. FIGS. 5-7 are described collectively.

The vacuum port 320 includes an upper region 324 that extends vertically above the top surface of the upper shell 302, an intermediate region 326 that extends through the upper shell 302, and a protruding region 329 that extends into the interior volume 309. The vacuum port 320 includes an inlet 328 and an outlet 330 and a hollow passage 332 extending from the inlet 328 to the outlet 330. The inlet 328 may be configured to couple to a suitable hose or passage coupled to a vehicle subsystem, e.g., a passage coupled to the crankcase of the engine. The vacuum port 320 may include a locking feature, such as a lip 321, to secure the hose or passage to the vacuum port 320. The outlet 330 may open into the interior of the intake manifold, e.g., the interior volume 309 formed by the first throat 310 and the second throat 312, behind the intermediate portion 305 of the throttle body mounting flanges. The hollow passage 332 may have a suitable diameter based on desired flow characteristics of the secondary gases. In the example shown, the hollow passage 332 has a diameter D1 and a length L1, where the length L1 is at least ten times as great as the diameter D1. By configuring the vacuum port 320 with a hollow passage having a relatively small diameter relative to a length of the hollow passage, the flow rate of the secondary gases may be increased relative to vacuum ports that include larger diameters and/or smaller lengths (such as vacuum ports that comprise simply an opening in the intake manifold). Further still, the hollow passage 332 may have a constant diameter and may extend in a straight line (e.g., without any curves or bends), but in some examples, the diameter of the hollow passage 332 may change at one or more portions of the vacuum port 320 and/or the hollow passage 332 may include one or more curves or bends.

The intermediate region 326 of the vacuum port 320 may be at least partially integrated with the upper shell 302. For example, as shown, an outer surface of the vacuum port 320 at the intermediate region 326 may include a first outer surface 325. The first outer surface 325 may be coupled to and continuous with an inner surface 342 of the upper shell 302 (on the side of the second throat 312, as shown, as well as on the side of the first throat 310). As such, the first outer surface 325 may extend only in a partial circumferential manner around the hollow passage 332, e.g., in a range of 250-350°.

Further, at the protruding region 329, the vacuum port 320 extends vertically downward from the upper shell 302 into the interior volume 309 of the intake manifold. Above the protruding region 329, the vacuum port 320 may be integrated with the upper shell 302, as described above. At the protruding region 329, a second outer surface 327 of the vacuum port 320 may extend in a fully circumferential manner around the hollow passage 332 (e.g., the second outer surface 327 may extend 360° around the hollow passage 332), as the second outer surface 327 may be present in the protruding region 329 and thus may not be directly coupled to the upper shell 302 or the lower shell 304. As appreciated by FIG. 5, the protruding region 329 may be positioned proximate to the lower shell 304. In some examples, the interior volume 309 of the intake manifold at the vacuum port 320 may have a vertical length extending from an interior surface of the upper shell 302 to an interior surface of the lower shell 304, and the vacuum port 320 may extend into the interior volume 309 more than 50% of the vertical length (e.g., such that the outlet 330 of the vacuum port 320 is closer to interior surface of the lower shell 304 than the interior surface of the upper shell 302, at least in some examples).

As mentioned previously, the vacuum port 320 may be integrated with the upper shell 302 of the intake manifold 300. As such, the vacuum port 320 may be formed at the same time as the upper shell 302, and may be molded with the upper shell 302. To form the vacuum port 320, a slide may be included with the mold/tools used to form the upper shell 302, and the slide may include a base for various cores and for forming mold cavities. For example, the slide may include a core for forming the hollow passage 332. In some examples, the slide may further include a mold core for forming at least portions of the walls of the vacuum port 320 (in some examples, additionally or alternatively, mold cores for forming some or all of the walls of the vacuum port 320 may be present on a different, cooperating slide or as part of the molds/tools used to form the upper shell 302, and/or the upper region 324 may be formed separately from the upper shell 302 and welded or otherwise fastened to the upper shell 324). The slide, other cooperating slides, and/or the molds/ tools used to form the upper shell 302 may be configured such that the mold cavity that forms the intermediate region 326 of the vacuum port 320 that is integrated with the upper shell (e.g., the region including the first surface 325) is continuous with the mold cavity that forms upper shell 302, at least in the region of the inner surface 342. To reduce manufacturing cost and complexity, the core for forming the hollow passage 332 may be included on the same slide as one or more cores/mold cores used to form additional ports on the upper shell 302, such as port 360. In such examples, the hollow passage 332 may be aligned with and/or extend parallel to the port 360, which may allow for ease of removal of the slide after molding. Further, by including the core for forming the hollow passage 332 on the same slide as used to form the port 360 and/or other features of the upper shell 302, manufacturing costs and complexity may be reduced.

In still further examples, the entirety of the vacuum port 320 may be manufactured separately from the upper shell 302 and inserted through an opening in the upper shell 302 after casting/molding of the upper shell 302. In such examples, the upper shell 302 may be cast/molded to include the opening and the body/spigot of the vacuum port 320 may be inserted into the opening such that the spigot extends through the upper shell 302, with the upper portion 324 extending upward from the upper shell 302 and the protruding region 329 extending downward from the upper shell 302, into the interior volume. In this example, the outer surface of the intermediate region 326 may not extend continuously with the upper shell 302 but may be in face-sharing contact (or within a threshold distance of) with the inner surface 342 of the upper shell 302 along a portion of the intermediate region 326, The flow disruptor 322 may be integrated with and extend vertically outward from the lower shell 304 (e.g., the flow disruptor may include an outer surface 331 that extends continuously with an inner surface 344 of the lower shell 304). The flow disruptor 322 may be formed during molding of the lower shell 304, e.g., the mold(s) used to form the lower shell 304 may include structure to form the flow disruptor 322. The flow disruptor 322 may be in the form of a cylinder or post that includes a top face 334 spaced apart from the outlet 330 of the vacuum port 320. Thus, a gap may be formed between the outlet 330 and the top face 334. The gap may have a distance that may be tuned to provide desired flow disturbance to the secondary gases in order to enhance mixing and even distribution of the secondary gases. In the example shown, the top face 334 may be substantially planar (e.g., extending in an x-z plane). However, in other examples, the top face 334 may be curved (e.g., curving upward toward the outlet 330, thereby forming a domed surface) or have another suitable geometry to facilitate distribution of the secondary gases.

In the example shown, the flow disruptor 322 may be solid and/or may have a continuous outer surface. As such, secondary gases injected by the vacuum port 320 and ingested intake gases may flow over and around the flow disruptor 322. However, in some examples, the flow disruptor 322 may include slots or other openings which may allow some secondary gas and/or intake gases to flow through the flow disruptor 322. In still further examples, additionally or alternatively, the flow disruptor 322 may include fins, ribs, and/or other surface features. The shape of and the presence or absence of the slots or surface features on the flow disruptor 322 may be selected to provide desired disruption to the flow of the secondary gases out of the vacuum port 320.

FIG. 9 shows a method 900 for operation of an intake system included in an internal combustion engine. Method 900 may be implemented by the systems, components, etc., described herein. However in other embodiments the method may be implemented via other suitable systems and components.

At 902, secondary gases are selectively introduced into a vacuum port leading to an engine intake manifold. For example, secondary gases may be selectively introduced into the intake manifold 300 of FIGS. 3-8 via the vacuum port 320. In some examples selectively introducing gases into a vacuum port may include, as indicated at 904, actuating one or more valves. It will be appreciated that the vacuum port may be coupled to a crankcase ventilation system, an evaporative emission system, a brake system, and/or an EGR system. Therefore selectively introducing gases into the vacuum port may include flowing gases from a vapor canister to the vacuum port, flowing air from an engine crankcase to the vacuum port, or flowing air from a brake system to assist the vehicle braking into the vacuum port. The gases may be introduced into the vacuum port during selected operating conditions, as previously discussed. Thus, one or more of a positive crankcase ventilation valve, a canister purge valve, an EGR valve, etc., may be actuated (e.g., opened) to introduce the secondary gases to the vacuum port.

At 906, the secondary gases are flown through a hollow interior of the spigot of the vacuum port. For example, as explained previously, the vacuum port 320 may be in the form of a spigot that includes a hollow passage coupling an inlet of the vacuum port to an outlet of the vacuum port. The spigot may extend vertically through the upper shell of the intake manifold and may terminate within an interior volume of the intake manifold. Thus, flowing the secondary gases through the hollow interior of the spigot of the vacuum port may include flowing the secondary gases into the hollow interior via an inlet, where the secondary gases flow through the upper shell of the intake manifold.

At 908, the secondary gases are injected from the spigot to the interior of the intake manifold, behind the throttle bodies and above a flow disruptor. The secondary gases may flow out of the outlet of the vacuum port and over and around the flow disruptor, where the secondary gases may mix with intake gases ingested via the throttle bodies. At 910, the method may further include flowing the gases from the intake manifold into a plurality of intake runners, and then the method ends.

The systems and methods described above enable the introduction of secondary gases into an intake manifold having two throttle bodies, via a vacuum port that facilitates even distribution of the secondary gases to the cylinders of the engine. Additionally, a flow disruptor may also promote mixing of gases from the vacuum port with intake air, decreasing combustion variability and improving combustion performance.

The disclosure also provides support for an intake system of an engine, comprising: an intake manifold coupled to a first throttle body and a second throttle body, the intake manifold formed from an upper shell and a lower shell, a vacuum port located in the intake manifold and in an air-flow path downstream of the first throttle body and the second throttle body and upstream of a plurality of intake runners of the intake manifold, the vacuum port including a spigot extending through the upper shell of the intake manifold, and a vacuum passage coupling the vacuum port to a vehicle subsystem. In a first example of the system, the vehicle subsystem comprises at least one of a brake booster, a positive crankcase ventilation system, and a fuel vapor purge system. In a second example of the system, optionally including the first example, the intake manifold includes a first throat coupled to the first throttle body via a first throttle body mounting flange and a second throat coupled to the second throttle body via a second throttle body mounting flange, and wherein the first throat and the second throat collectively form an interior volume upstream of the plurality of intake runners. In a third example of the system, optionally including one or both of the first and second examples, the spigot includes a hollow passage extending vertically from an inlet of the spigot to an outlet of the spigot, the inlet positioned vertically above the upper shell, the outlet positioned within the interior volume. In a fourth example of the system, optionally including one or more of each of the first through third examples, the spigot includes an upper region that extends from the upper shell to the inlet, a protruding region that extends from the outlet to the upper shell, and an intermediate region that is integrated with the upper shell. In a fifth example of the system, optionally including one or more of each of the first through fourth examples, the protruding region is positioned within the interior volume and includes an outer surface that extends circumferentially around the hollow passage. In a sixth example of the system, optionally including one or more of each of the first through fifth examples, the upper shell includes a trough where the first throat couples to the second throat, and wherein the intermediate region of the spigot is integrated with the upper shell at the trough. In a seventh example of the system, optionally including one or more of each of the first through sixth examples, the system further comprises: a flow disruptor integrated in the lower shell of the intake manifold. In an eighth example of the system, optionally including one or more of each of the first through seventh examples, the flow disruptor is aligned with and spaced apart from the spigot. In one or more or each of the previous examples, the spigot may be integrated with the upper shell of the intake manifold.

The disclosure also provides support for an intake system of an engine, comprising: an intake manifold coupled to a first throttle body and a second throttle body via a first throttle body mounting flange and a second throttle mounting flange, the intake manifold formed from an upper shell and a lower shell, a vacuum port located in the intake manifold and in an air-flow path downstream of the first throttle body and the second throttle body and upstream of a plurality of intake runners, the vacuum port including a spigot extending through the upper shell of the intake manifold and positioned adjacent an intermediate portion coupled between the first throttle body mounting flange and the second throttle body mounting flange, a flow disruptor integrated in the lower shell, the flow disruptor aligned along a common axis with the spigot and having a top face spaced apart from an outlet of the spigot, and a vacuum passage coupling the vacuum port to a vehicle subsystem. In a first example of the system, the intake manifold includes a first throat coupled to the first throttle body via the first throttle body mounting flange and a second throat coupled to the second throttle body via the second throttle body mounting flange, and wherein the first throat and the second throat collectively form an interior volume upstream of the plurality of intake runners. In a second example of the system, optionally including the first example, the spigot extends vertically from the upper shell into the interior volume and the flow disruptor extends vertically from the lower shell into the interior volume. In a third example of the system, optionally including one or both of the first and second examples, the first throat and the second throat each extend parallel to a central longitudinal axis of the intake manifold, and wherein the first throttle body mounting flange and the second throttle body mounting flange each have a front face that extends at a non-perpendicular angle with respect to the central longitudinal axis. In a fourth example of the system, optionally including one or more of each of the first through third examples, the vacuum port is positioned at a trough between the first throat and the second throat and is located closer to the intermediate portion than to the plurality of intake runners. In a fifth example of the system, optionally including one or more of each of the first through fourth examples, the top face of the flow disruptor is planar. In a sixth example of the system, optionally including the one or more of each of first through fifth examples, the top face of the flow disruptor is domed. In one or more or each of the previous examples, the spigot may be integrated with the upper shell of the intake manifold.

The disclosure also provides support for an intake system of an engine, comprising: an intake manifold coupled to a first throttle body and a second throttle body, the intake manifold formed from an upper shell and a lower shell and including a first throat and a second throat coupling the first throttle body and the second throttle body to a plurality of intake runners, a vacuum port including a spigot extending through the upper shell of the intake manifold at a trough between the first throat and the second throat and having an outlet positioned in an air-flow path downstream of the first throttle body and the second throttle body and upstream of the plurality of intake runners, and a vacuum passage coupling the vacuum port to a vehicle subsystem. In a first example of the system, the first throttle body is coupled to the first throat via a first throttle body mounting flange and the second throttle body is coupled to the second throat via a second throttle body mounting flange, and wherein the vacuum port is positioned closer to the first throttle body mounting flange and second throttle body mounting flange than to the plurality of intake runners. In a second example of the system, optionally including the first example, the spigot includes an upper region that extends from the upper shell to an inlet of the spigot, a protruding region that extends from the outlet to the upper shell, and an intermediate region that is integrated with the upper shell. In a third example of the system, optionally including one or both of the first and second examples, the upper shell includes an inner surface at the trough, the inner surface extending continuously with an outer surface of the intermediate region of the spigot. In one or more or each of the previous examples, the spigot may be integrated with the upper shell of the intake manifold.

FIGS. 1-8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and sub-combinations of the various features, functions, acts, and/or properties disclosed herein, as well as any and all equivalents thereof.

The invention claimed is:

1. An intake system of an engine, comprising:

an intake manifold coupled to a first throttle body and a second throttle body, the intake manifold formed from an upper shell and a lower shell;

a vacuum port located in the intake manifold and in an air-flow path downstream of the first throttle body and the second throttle body and upstream of a plurality of intake runners of the intake manifold, the vacuum port including a spigot extending through the upper shell of the intake manifold; and a vacuum passage coupling the vacuum port to a vehicle subsystem.

2. The intake system of claim 1, wherein the vehicle subsystem comprises at least one of a brake booster, a positive crankcase ventilation system, and a fuel vapor purge system.

3. The intake system of claim 1, wherein the intake manifold includes a first throat coupled to the first throttle body via a first throttle body mounting flange and a second throat coupled to the second throttle body via a second throttle body mounting flange, and wherein the first throat and the second throat collectively form an interior volume upstream of the plurality of intake runners.

4. The intake system of claim 3, wherein the spigot includes a hollow passage extending vertically from an inlet of the spigot to an outlet of the spigot, the inlet positioned vertically above the upper shell, the outlet positioned within the interior volume.

5. The intake system of claim 4, wherein the spigot includes an upper region that extends from the upper shell to the inlet, a protruding region that extends from the outlet to the upper shell, and an intermediate region that is integrated with the upper shell.

6. The intake system of claim 5, wherein the protruding region is positioned within the interior volume and includes an outer surface that extends circumferentially around the hollow passage.

7. The intake system of claim 5, wherein the upper shell includes a trough where the first throat couples to the second throat, and wherein the intermediate region of the spigot is integrated with the upper shell at the trough.

8. The intake system of claim 1, further comprising a flow disruptor integrated in the lower shell of the intake manifold.

9. The intake system of claim 8, wherein the flow disruptor is aligned with and spaced apart from the spigot.

10. An intake system of an engine, comprising:

an intake manifold coupled to a first throttle body and a second throttle body via a first throttle body mounting flange and a second throttle body mounting flange, the intake manifold formed from an upper shell and a lower shell;

a vacuum port located in the intake manifold and in an air-flow path downstream of the first throttle body and the second throttle body and upstream of a plurality of intake runners, the vacuum port including a spigot extending through the upper shell of the intake manifold and positioned adjacent an intermediate portion coupled between the first throttle body mounting flange and the second throttle body mounting flange;

a flow disruptor integrated in the lower shell, the flow disruptor aligned along a common axis with the spigot and having a top face spaced apart from an outlet of the spigot; and a vacuum passage coupling the vacuum port to a vehicle subsystem.

11. The intake system of claim 10, wherein the intake manifold includes a first throat coupled to the first throttle body via the first throttle body mounting flange and a second throat coupled to the second throttle body via the second throttle body mounting flange, and wherein the first throat and the second throat collectively form an interior volume upstream of the plurality of intake runners.

12. The intake system of claim 11, wherein the spigot extends vertically from the upper shell into the interior volume and the flow disruptor extends vertically from the lower shell into the interior volume.

13. The intake system of claim 11, wherein the first throat and the second throat each extend parallel to a central longitudinal axis of the intake manifold, and wherein the first throttle body mounting flange and the second throttle body mounting flange each have a front face that extends at a non-perpendicular angle with respect to the central longitudinal axis.

14. The intake system of claim 11, wherein the vacuum port is positioned at a trough between the first throat and the second throat and is located closer to the intermediate portion than to the plurality of intake runners.

15. The intake system of claim 10, wherein the top face of the flow disruptor is planar.

16. The intake system of claim 10, wherein the top face of the flow disruptor is domed.

17. An intake system of an engine, comprising:

an intake manifold coupled to a first throttle body and a second throttle body, the intake manifold formed from an upper shell and a lower shell and including a first throat and a second throat coupling the first throttle body and the second throttle body to a plurality of intake runners;

a vacuum port including a spigot extending through the upper shell of the intake manifold at a trough between the first throat and the second throat and having an outlet positioned in an air-flow path downstream of the first throttle body and the second throttle body and upstream of the plurality of intake runners; and a vacuum passage coupling the vacuum port to a vehicle subsystem.

18. The intake system of claim 17, wherein the first throttle body is coupled to the first throat via a first throttle body mounting flange and the second throttle body is coupled to the second throat via a second throttle body mounting flange, and wherein the vacuum port is positioned closer to the first throttle body mounting flange and second throttle body mounting flange than to the plurality of intake runners.

19. The intake system of claim 17, wherein the spigot includes an upper region that extends from the upper shell to an inlet of the spigot, a protruding region that extends from the outlet to the upper shell, and an intermediate region that is integrated with the upper shell.

20. The intake system of claim 19, wherein the upper shell includes an inner surface at the trough, the inner surface extending continuously with an outer surface of the intermediate region of the spigot.

* * * * *